United States Patent [19]

Heine

[11] 4,395,037

[45] Jul. 26, 1983

[54] APPARATUS FOR STACKING TEXTILE FABRIC SHEETS ON TOP OF ONE ANOTHER

[75] Inventor: Rolf Heine, Rinteln, Fed. Rep. of Germany

[73] Assignee: Herbert Kannegiesser GmbH & Co., Vlotho, Fed. Rep. of Germany

[21] Appl. No.: 265,494

[22] Filed: May 20, 1981

[30] Foreign Application Priority Data

Jun. 16, 1980 [DE] Fed. Rep. of Germany ..... 3022619

[51] Int. Cl.[3] ..... B65H 29/70

[52] U.S. Cl. ..... 271/188; 271/189; 271/219

[58] Field of Search ..... 271/84, 188, 189, 215, 271/217–219, 366

[56] References Cited

U.S. PATENT DOCUMENTS

| | | | |
|---|---|---|---|
| 3,135,509 | 6/1964 | Zweig | 271/188 |
| 3,298,683 | 1/1967 | Stroud | 271/218 |
| 4,284,462 | 8/1981 | Heine | 271/84 X |

*Primary Examiner*—Richard A. Schacher

*Attorney, Agent, or Firm*—Sughrue, Mion, Zinn, Macpeak and Seas

[57] ABSTRACT

An apparatus for clamping individual pieces of textile fabric exiting a fusing machine conveyor 13, for withdrawing the fabrics until the trailing edges thereof clear a photocell sensor 42, and for stacking the fabrics with aligned leading edges on a hinged and vertically movable table 19 includes a withdrawable stacking rake 21 and a cooperable, vertically movable clamping plate 20. The rake and plate comprise a plurality of laterlly spaced, longitudinally oriented prongs 38 and rods 37, respectively, which are relatively staggered such that they may be partially interleaved during operation to clamp a piece of fabric therebetween.

5 Claims, 3 Drawing Figures

APPARATUS FOR STACKING TEXTILE FABRIC SHEETS ON TOP OF ONE ANOTHER

BACKGROUND OF THE INVENTION

The invention relates to a stacking apparatus for stacking sheet-like textile fabrics or the like on top of one another, and is especially adapted to be used with fusing devices which apply glue to textile fabrics in the manufacture of outer clothing. The apparatus, has, connected to a feed mechanism, a stacking table mounted to be movable vertically, a clamping plate which can be pressed thereon, and a stacking rake which can be reciprocated forward and backwards between the stacking table and the clamping plate in the conveying direction of the feed mechanism, and onto which the fabrics are conveyed by the feed mechanism, in order to be deposited on the stacking table.

In a known stacking apparatus as disclosed in commonly assigned U.S. Pat. No. 4,284,462, the textile fabrics, when conveyed onto the stacking rate, actuate by means of their front edges a photoelectric detector located in the region of a strip-off rake. The result of actuating this photoelectric detector is that the stacking rake is moved in the conveying direction of the feed mechanism, the front part of the fabrics being deposited on the stacking table, which is located under the stacking rake, as a result of the mode of operation of the stacking rake and of a strip-off rake interacting therewith. During this time, the stacking rake is moved out of the clamping region of the clamping plate, so that the latter can subsequently be pressed onto the stacking table, including with it the fabrics, the stacking table being lowered each time by at least the thickness of the deposited fabric. When this has been effected, both the clamping plate and the stacking rake are moved back again into their original positions, although, because of the prevailing conditions, the backward movement of the stacking rake takes place only after the backward movement of the clamping plate. Only after that is the stacking apparatus ready for the next stacking operation.

A disadvantage of the known stacking apparatus is that the stacking rake can be moved back into its basic position only after the clamping plate has been moved back into its basic position, as a result of which the output of the stacking apparatus is lower than that of the gluing device. A further disadvantage of the known stacking apparatus is to be seen in the fact that, when they are conveyed onto the stacking rake and in the course of the depositing operation, the fabrics are deformed and/or displaced more or less markedly, depending on their constitution, for example a light or heavy quality of material and/or smaller or larger dimensions. The deformation is revealed, for example, in the formation of corrugations due to pushing-up (in the conveying operation) and in the form of bulges resembling the latter (in the depositing operation).

SUMMARY OF THE INVENTION

The object on which the invention is based is to propose a stacking apparatus of the type mentioned above, which in the region of the stacking rake and clamping plate works more rapidly, in particular, and more advantageously in terms of conveying and depositing, than the known stacking apparatus.

By means of the design according to the invention of the region of the stacking rake and clamping plate, it is possible to move the stacking rake into its basic position even before or else simultaneously with the backward movement of the clamping plate into its basic position. The output of the stacking apparatus can thereby be increased.

The output of the stacking apparatus can be further increased, since the stacking rake can be moved back into its basic position even during the course of the pressing-on movement of the clamping plate, but, at the very least, this movement can be started without hesitation. The textile fabrics conveyed by the feed mechanism onto the stacking rake, at a speed which is high per se, slide, gently braked, into their final position on the stacking rake. During the subsequent movement of the stacking rake, the rods of the clamping plate act as holding-down devices. Deformations in the form of corrugations due to pushing-up, bulges and/or displacements are thereby largely avoided.

BRIEF DESCRIPTION OF THE DRAWINGS

Further advantageous features of the invention are explained below with reference to an exemplary embodiment illustrated diagrammatically in the drawings in which.

DETAILED DESCRIPTION OF THE PREFERRED EMBODIMENTS

Figure 1:
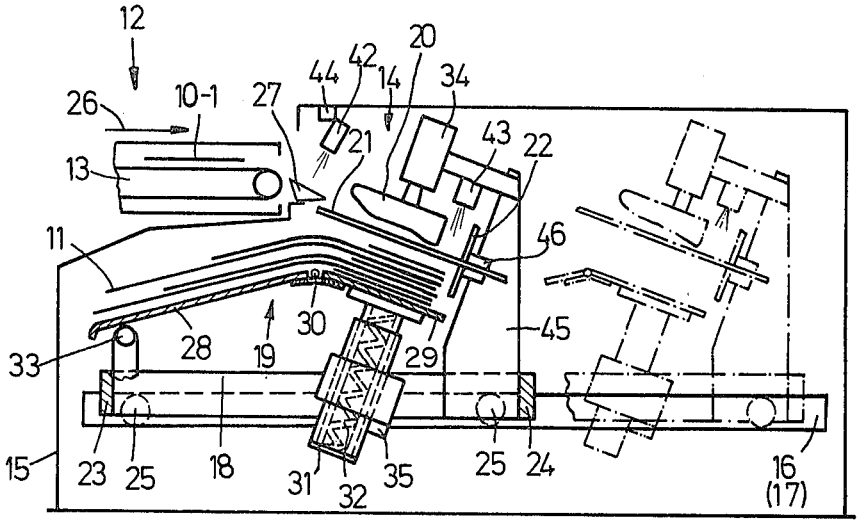
FIG. 1 shows a longitudinal section through a stacking apparatus, with a stacking unit movable in the conveying direction of the feed mechanism, the stacking unit being indicated in two positions.

The stacking apparatus 14 according to the invention, which is illustrated in FIG. 1 at the end of a conveyor belt 13 serving as a feed mechanism 12 and belonging to a device, not shown in more detail, for the continuous gluing of sheet-like textile fabrics, and which is intended for stacking on top of one another textile fabrics 10-1 (outer material and inter-lining), which rest on the conveyor belt 13 and are glued to one another, consists, in the first place, of a frame 15 with guide rails 16, 17 for a running gear or carrier 18 on which the actual stacking unit is located, the latter consisting essentially of a vertically movable stacking table 19, a clamping plate 20 which can be pressed thereon, and a stacking rake 21 and strip-off rake 22. The running gear 18 has two crossmembers 23, 24 and four running rollers 25. The running gear 18, together with the stacking unit, can be moved in the conveying direction (arrow 26) of the feed mechanism 12 and back again by means of devices known per se and not shown in the drawings, for example by means of bidirectional working cylinders. The table plate of the stacking table 19 is designed in two parts. Its two parts are articulated to one another by means of a hinge 30 and are arranged approximately in the form of a roof when in their unloaded position, and, furthermore, are mounted on the running gear 18 so that, during the course of the stacking operations, their position can be varied in dependence on the height of the stack of fabrics 11 stacked thereon. That part 29 of the table plate of the stacking table 19 which is located at the front in the conveying direction (arrow 26) of the feed mechanism 12 is mounted to be movable vertically on its underside on the running gear 18 and has, for this purpose, among other things, guide sleeves 31 and a compression spring 32 located within the latter. The other part 28 of the table plate rests at its free end on two guide rollers 33. The clamping plate 20, likewise mounted vertically movably, together with a guide and drive 34 for same, is located, above the part 29, on a mounting bracket (45) which is, in turn, fastened to the running gear 18. The clamping plate 20 and the stacking table 19 or the part 29 of the table plate of same are, furthermore, arranged so that the lowest position of the vertically movable clamping plate 20 is identical to the highest position of the stacking table 19 or the top edge of the stack 11, resting thereon, of textile fabrics. The vertically movable stacking table 19 is automatically retained, after each lowering thereof by the clamping plate 20, by means of a detent 35 (FIG. 1). This retention can be released electrically and by means of a lever not shown in the drawing, for example whenever the stacking table has been unloaded in the final position shown by dot-and-dash lines in FIG. 1. The stacking rake 21, which is located between the stacking table 19 and clamping plate 20 and which interacts with the stationary strip-off rake 22, can be moved forwards and backwards in the conveying direction (arrow 26) of the feed mechanism 12 by means of devices known per se and likewise not shown in the drawings, for example by means of bidirectional working cylinders. The tines or prongs 38 of the stacking rake 21 are mounted and guided a the guide bearing 46 which is located on the mounting bracket 45 and which has a bearing bush 47 for each prong 38.

Figure 3:
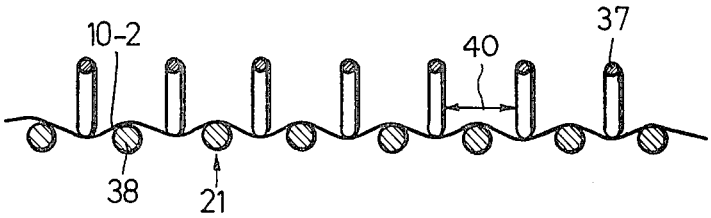
FIG. 3 shows a section along the sectional line A—A in FIG. 2, with a textile piece located in the intake gap, in an illustration which is somewhat enlarged in comparison with FIG. 2.
Figure 2:
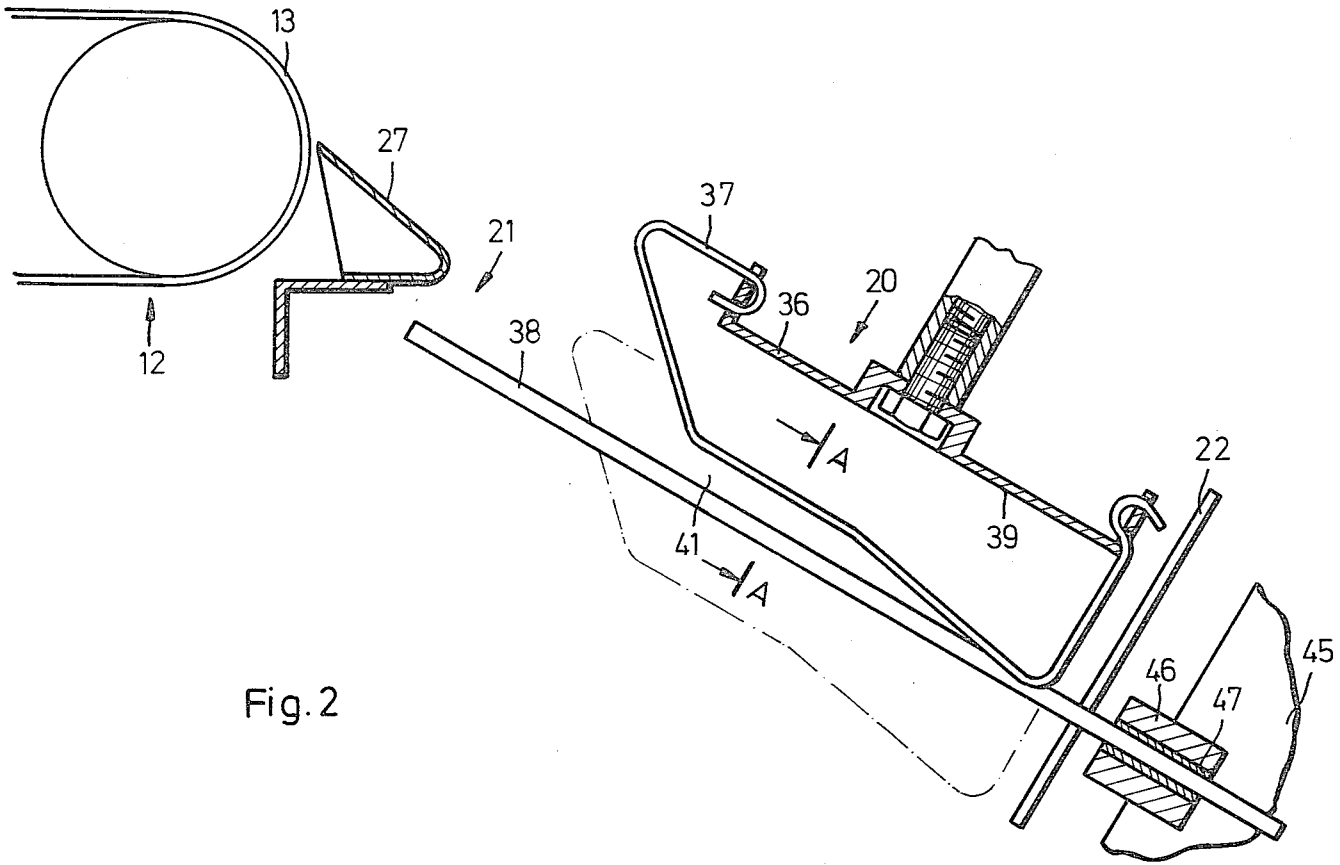
FIG. 2 shows the design according to the invention of the region of the stacking rake and clamping plate, in an illustration which is enlarged in comparison with FIG. 1.

The clamping plate 20 consists essentially of a metal plate 36 and of rods 37 (FIG. 2) which are located at a distance below the metal plate 36, but are connected to the latter, and which are spaced from one another according to the spacing of the prongs 38 of the stacking rake 21. As is evident especially from FIG. 2, the rods 37 are bent in a very special way and are fastened to the metal plate 36. The distance of the rods 37 from the lower face 39 of the metal plate 36 is greater in the rear region of the clamping plate 20 that the stroke of the clamping plate 20 plus the height or the diameter of the prongs 38 of the stacking rake 21. Furthermore, the prongs of the stacking rake 21 and the rods 37 of the clamping plate 20 are offset or staggered from one another in the working plane of the stacking rake 21, in such a way that the rods 37 of the clamping plate 20 are located centrally between the prongs 38 of the stacking rake 21 (FIG. 3). The rod-shaped clamping plate 20 thus has longitudinal spaces or recesses 40 on its pressure side whereby it can be introduced into or partially interleaved with the stacking rake 21. As a result of said special bending of the rods 37 of the clamping plate 20, it is possible, after the stacking rake 21 and clamping plate 20 have been pushed a little way into one another, to form, on the feed side of the sheet-like textile fabrics, between the prongs 38 of the stacking rake 21 and the rods 37 of the clamping plate 20, an intake gap 41 which becomes smaller towards the rear region of said clamping plate (FIG. 2). A baffle plate 27, located at the end of the feed mechanism 12 or the conveyor belt 13 of same, is mounted in front of the intake gap 41 to ensure a good transfer of the sheet-like textile fabrics onto the stacking rake 21 and a similarly good introduction of these into said intake gap 41.

Among other things, photoelectric detectors 42, 43 are provided to control the travelling movement of the running gear 18 and to control the movement of the stacking rake 21 and of the clamping plate 20. The photoelectric detector 42 is fastened, at the start of the stacking apparatus 14, to an upper crossmember 44 of the frame 15 of said apparatus. The photoelectric detector 43 is fastened to the mounting bracket 45 of the running gear 18.

Moreover, the stacking apparatus illustrated in the drawings has all further parts and devices known per se which are required for its operation. Furthermore, like the embodiments in West German Pat. No. 2,325,469 and U.S. Pat. No. 4,284,462, it can have several working regions located next to one another.

The mode of operation of the stacking apparatus shown in the drawings is as follows:

The textile fabrics 10-1, which rest on the continuously driven conveyor belt 13 of the feed mechanism 12 and which are glued to one another, are conveyed by said conveyor belt onto the stacking rake 21. During this conveyance, the fabrics 10-1 slide over the baffle plate 27 located at the end of the feed mechanism 12, and thence into the intake gap 41 formed by the rods 37 of the clamping plate 20 and the prongs 38 of the stacking rake 21 (FIG. 2). During this conveyance, fabrics actuate by means of their front edge the photoelectric detectors 42, 43. The result of actuating the photoelectric detector 43 is that the stacking rake 21 is moved in the conveying direction (arrow 26), while, because of the mode of operation of the stacking rake 21 and of the strip-off rake 22, the front part of the fabric is deposited onto that part 29 of the two-part table plate of the stacking table 19 which is located under the stacking rake 21 and parallel thereto, or onto the fabrics 11 already stacked on said stacking table. Immediately thereafter, the clamping plate 20 is pressed onto that section of the fabrics which rests on the part 29 of the table plate, and, during this time, the part 29 of the table plate is lowered by the thickness of the clamped fabric and is retained in this position by the detent 35. When this has been effected and when the light beam of the photoelectric detector 42 is still interrupted by the rear part of the clamped fabric, or when the clamped fabric is longer in the conveying direction (arrow 26) than the distance between the strip-off rake 22 and the light beam of the photoelectric detector 42, then the running gear 18, carrying the stacking unit is moved in the conveying direction until the light beam is no longer interrupted, namely moved, for example, up to a final position shown by dot-and-dash lines in FIG. 1. Furthermore, when the light beam of the photoelectric detector 42 becomes unobstructed, the backward or return movement of the running gear 18 into its initial position is started. When this position has been reached, the clamping plate 20 and stacking rake 21 are moved back again into their original positions according to FIG. 2, the backward movement of the stacking rake 21 taking place before or at least simultaneously with the lifting of the clamping plate 20. When this has been effected, the stacking apparatus is ready for the next stacking operation.

As a result of the design and mutual arrangement of the clamping plate 20 and stacking rake 21 evident from FIGS. 2 and 3, the fabrics 10-2 conveyed onto the stacking rake 21 are braked gently and are thereby very largely free of corrugations due to pushing-up and/or displacements when in their final position on the stacking rake. During the subsequent movement of the stacking rake 21 in the conveying direction (arrow 26), in order to deposit on the already stacked fabrics 11 (FIG. 1) further fabrics 10-2 (FIG. 3) resting on said stacking rake, the rods 37 of the clamping plate 20 act as hold-down devices, as a result of which, even in this phase of the stacking operation, the fabrics 10-2 are held and prevented from bulging.

The remaining mode of operation of the stacking apparatus corresponds to that of the stacking apparatus according to U.S. Pat. No. 4,284,462, mentioned with regard to the state of the art.

I claim:

1. Stacking apparatus for stacking sheet-like textile fabrics or the like on top of one another as they exit devices for processing textile fabrics in the manufacture of articles of outer clothing on a feed mechanism (12), which apparatus includes a stacking table (19) mounted to be movable vertically, a movable clamping plate (20) mounted to be pressed towards the stacking table, and a stacking rake (21) disposed between the stacking table and the clamping plate and movable forwards and backwards in the conveying direction of the feed mechanism and onto which the textile fabrics are conveyed by the feed mechanism, in order to be deposited on the stacking table, characterised by: the stacking rake comprising a plurality of laterally spaced and longitudinally oriented prongs (38) and the clamping plate defining, on a clamping side thereof, a plurality of laterally spaced and longitudinally oriented recesses (40) located in a working region of the stacking rake prongs and cooperable therewith to grippingly engage textile fabrics, the width of said recesses corresponding at least to the cross-sectional width of said prongs.

2. Stacking apparatus according to claim 1, wherein the clamping plate comprises a metal plate (36) and a plurality of rods (37) located below the metal plate and connected thereto, said rods being laterally spaced from one another corresponding to the lateral spacing between the stacking rake prongs, and the space between said rods and said metal plate defining said recesses.

3. Stacking apparatus according to claim 2, wherein the distance between the rods and a lower face (39) of the metal plate corresponds at least to the stroke of the clamping plate plus the diameter of the stacking rake prongs.

4. Stacking apparatus according to claim 1, wherein the clamping plate rods extend further downwardly in the rear region to define, after the stacking rake and clamping plate have been partially interleaved, an intake gap (41) for the textile fabrics which convergingly tapers towards the rear region of the clamping plate.

5. Stacking apparatus according to claim 2, wherein the clamping plate rods and stacking rake prongs are laterally offset to enable their interleaving.

* * * * *